US005921112A

United States Patent [19]

Boved

[11] Patent Number: 5,921,112

[45] Date of Patent: Jul. 13, 1999

[54] TRANSMITTER HOUSING FOR A WATER LEVEL TRANSMITTER IN A WASHING MACHINE

[75] Inventor: Ismael Gracia Boved, Zaragoza, Spain

[73] Assignee: Balay S.A., Zaragoza, Spain

[21] Appl. No.: 08/906,516

[22] Filed: Aug. 5, 1997

[30] Foreign Application Priority Data

Aug. 5, 1996 [ES] Spain ..... 9602144

[51] Int. Cl.[6] ..... D06F 33/00

[52] U.S. Cl. ..... 68/12.21; 68/207; 73/299; 137/387

[58] Field of Search ..... 68/207, 12.21, 68/12.05; 73/301, 299, 756; 137/387, 390

[56] References Cited

U.S. PATENT DOCUMENTS 2,962,048 11/1960 Steidley ..... 137/187
3,159,174 12/1964 Searle et al. ..... 137/187
3,918,457 11/1975 Racenis ..... 137/387
4,697,293 10/1987 Knoop ..... 8/158

*Primary Examiner*—Jill Warden
*Assistant Examiner*—Paul Lee
*Attorney, Agent, or Firm*—Herbert L. Lerner; Laurence A. Greenberg

[57] ABSTRACT

A transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, includes a transmitter housing body having one of a jet molded and an injection molded generally hollow-cylindrical shape and includes devices for fastening the transmitter housing body to the nozzle of the lye runoff bellows, and devices for connecting the transmitter housing body to a body of the tub.

19 Claims, 3 Drawing Sheets

FIG.4A
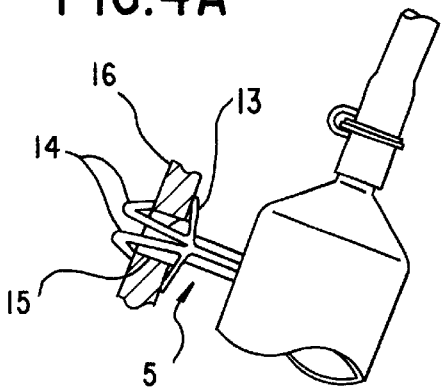
FIG.4
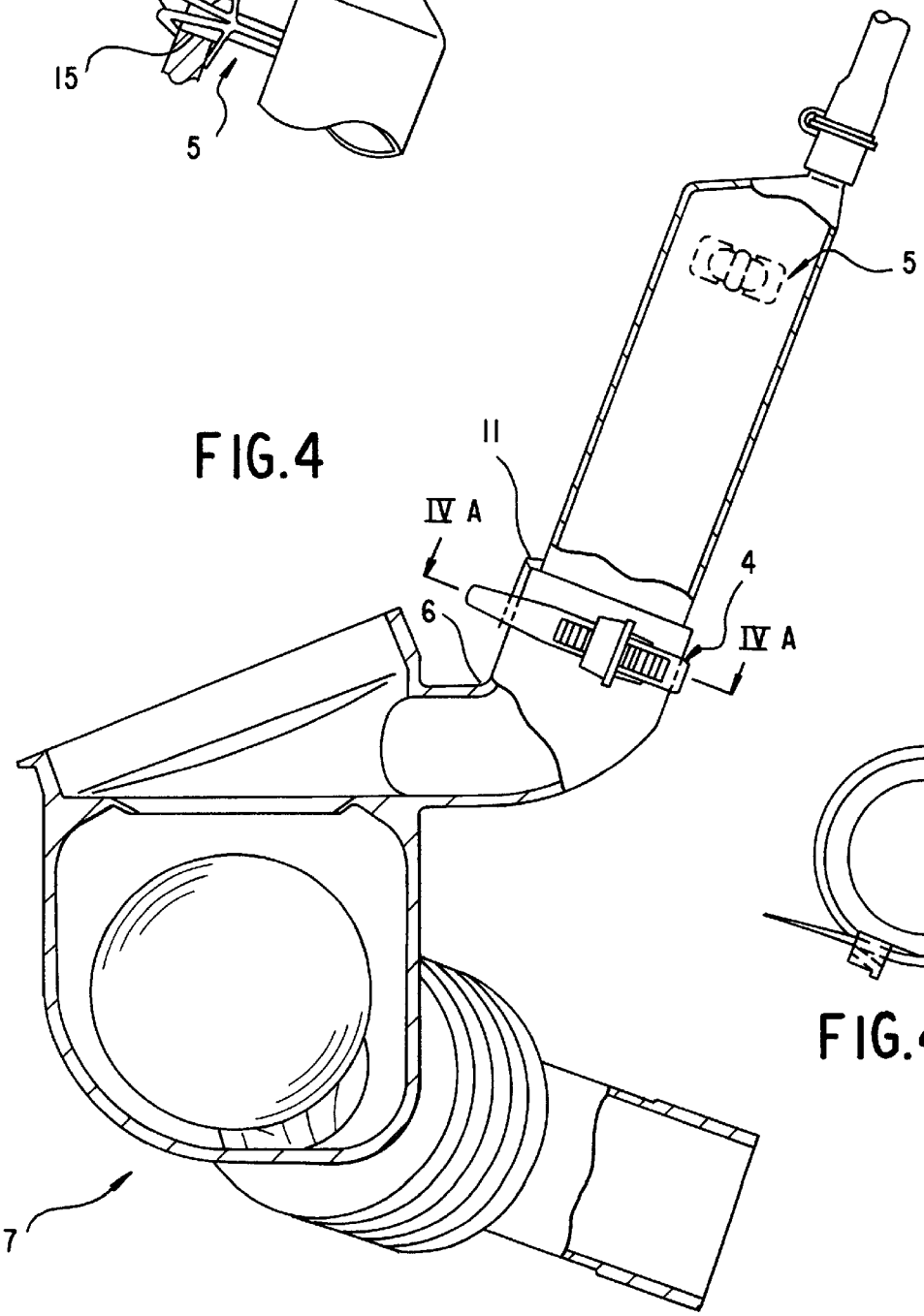
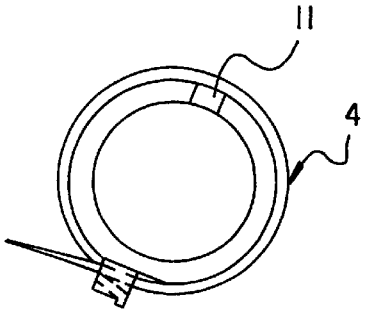
FIG.4B

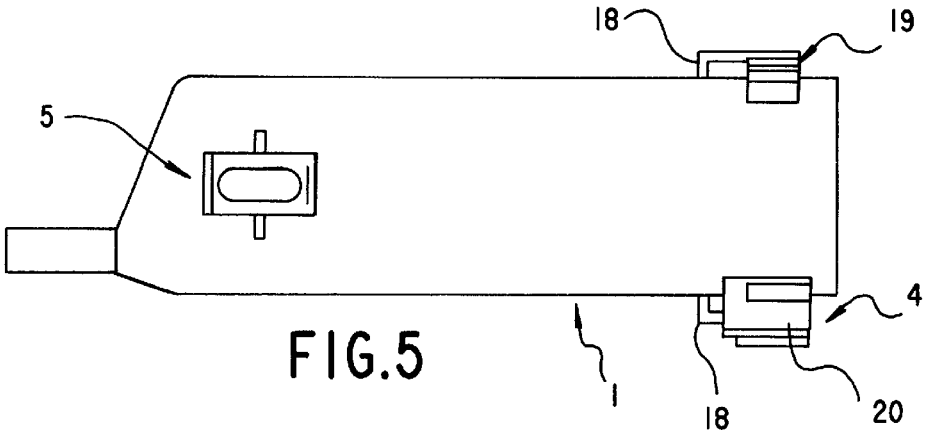
FIG.5
FIG.6
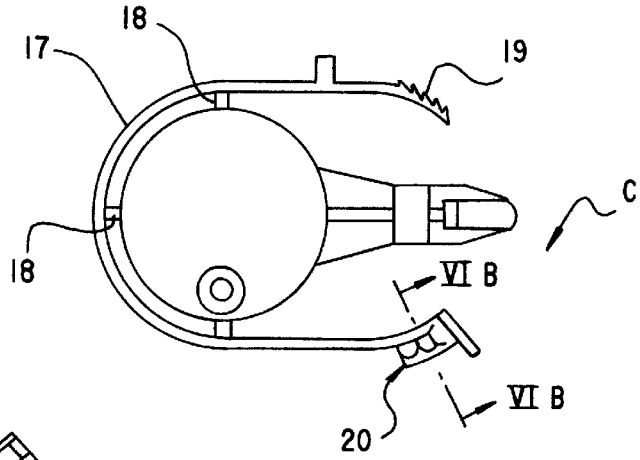
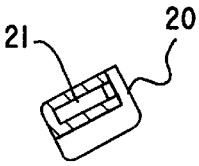
FIG.6B
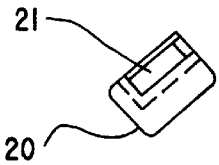
FIG.6A
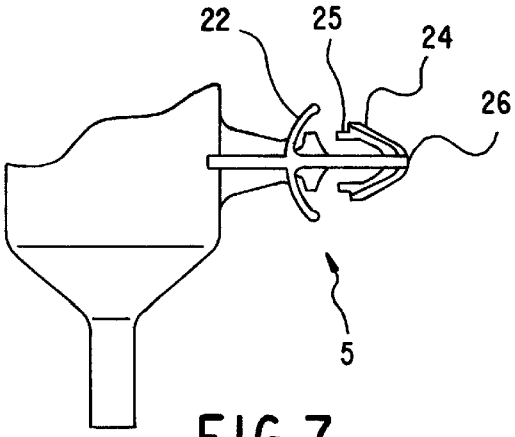
FIG.7
FIG.8
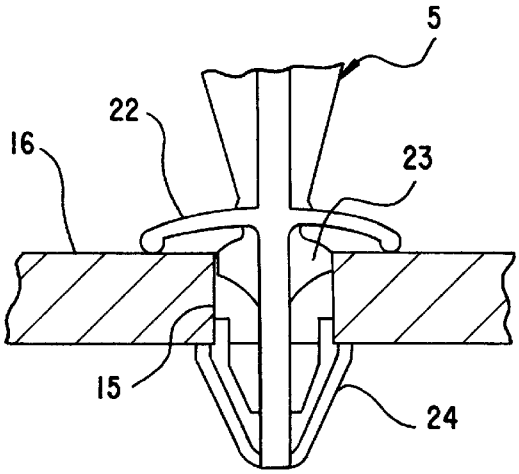

TRANSMITTER HOUSING FOR A WATER LEVEL TRANSMITTER IN A WASHING MACHINE

BACKGROUND OF THE INVENTION

FIELD OF THE INVENTION

The invention described in the instant application relates to a transmitter housing for connecting a water level transmitter to a lye or washing solution runoff bellows in a washing machine, the transmitter housing having an essentially elongated and cylindrical shape which is connected at a basal end face thereof to a corresponding nozzle or union of the lye runoff bellows of a tub of the washing machine and is connected by the other basal end face thereof to the water level transmitter.

As is generally known, such a transmitter housing is substantially tubular, being connected, at a basal end face thereof having a smaller cross section than that of the other basal end face thereof, to the water level transmitter which is based upon the so-called pressure measurement principle. Conventionally, at the basal end face of the transmitter housing having the larger cross section, such a pressure transmitter housing is connected to a nozzle or union of a lye runoff bellows at a lower orifice of the tub of the washing machine and is fastened by a pipe strap or a hose clamp.

The transmitter housing according to the invention which is described herein serves for use in automatic washing machines and, by being connected to a standard line of the rubber bellows for effecting runoff from the tub, and to the water level transmitter, permits the water level in the tub to be checked.

It is therefore necessary for the body of the transmitter housing to be completely leakproof in order to ensure fully satisfactory functioning, because faulty measurement of the apparatus may otherwise result.

Of the transmitter housing bodies heretofore provided in the marketplace, that which is formed by a tubular body is significant for the invention of the instant application. For the purpose of connecting the transmitter housing to the nozzle or union of the rubber lye runoff bellows of the washing machine tub, the tubular body, at the basal end faces thereof, terminates in a portion having a cross section formed as a circular ring or crown which is slipped onto the rubber union or nozzle and fastened by a metal clip, whereas, at the other basal end face thereof, the transmitter housing body has a tubular outlet having a cross section of a circular ring of relatively small diameter which is connected to the water level transmitter.

In addition, in order to fasten the transmitter housing securely, the latter is affixed to the body of the tub by a clip formed of plastic material and a suitable fastening screw.

On the other hand, the substantially tubular portion of the transmitter housing has an oval portion with very large flattened sides, several bends being described thereby, due to which it is not possible to reproduce the shape thereof by an injection molding process, because the transmitter housing has undercuts in the structure thereof. The transmitter housing body is therefore produced by a more expensive blowing or blasting operation and, at the surface thereof, has some unevennesses which could give rise to leakage at the connection locations.

As a consequence thereof, and because the transmitter housing body must be completely leakproof, the end for connecting the transmitter housing body to the union or nozzle of the lye runoff bellows of the tub has a smooth outer surface, in order to achieve complete tightness against leakage. Furthermore, because the ends of the transmitter housing body can be produced by a blowing or blasting operation only without any thickening at the outer ends thereof, the tube ends of the transmitter housing exhibit great flexibility which, during the fastening operation, may result in deformations and therefore to a malfunction of the apparatus, because it is not completely leakproof.

SUMMARY OF THE INVENTION

It is accordingly an object of the invention to provide a transmitter housing for a water level transmitter in a washing machine with continuous surface shapes for more cost-effective production and for ensuring leaktightness or a leakproof construction, with lower costs of the elements thereof and with greater simplicity and speed in the assembly operations associated therewith, during the connection both to the lye runoff bellows of the tub and to the body of the tub itself, thereby entailing lower costs with regard to mass production.

With the foregoing and other objects in view, there is provided, in accordance with the invention, a transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, comprising a transmitter housing body having one of a jet molded and an injection molded generally hollow-cylindrical shape and including devices for fastening the transmitter housing body to the nozzle of the lye runoff bellows and devices for connecting the transmitter housing body to a body of the tub.

In accordance with another feature of the invention, the basal end faces are formed on the transmitter housing body and have small reinforcing thickenings.

In accordance with another feature of the invention, the devices for fastening the transmitter housing body to the nozzle of the lye runoff bellows include a fastening clip fixedly connected to the transmitter housing body and being disposed in the vicinity of one of the basal end faces through the intermediary of a flexible strap or web.

In accordance with a further feature of the invention, the fastening clip includes a partially toothed strip which, when passed through a slot-like orifice in a toothed end head of the fastening clip, is in cooperative engagement with at least one tooth of the end head.

In accordance with an added feature of the invention, in an assembled position of the transmitter housing, the nozzle abuts the flexible web of the fastening clip which, for fastening the transmitter housing to the nozzle, is pivotable through an angle of 90° towards the nozzle and is closable in the end head by the toothed strip.

In accordance with an additional feature of the invention, the devices for fastening the transmitter housing body to the body of the tub include a clamp engageable with the tub body through an orifice formed in a projection of the tub body.

In accordance with yet another feature of the invention, the clamp for fastening the transmitter housing body to the tub has a radial extension formed with a pair of wings directed resiliently towards a free end of the radial extension and having a substantially rectangular profile, and a pair of spread-open arms terminating in the form of a barb tip springable from a middle part of the extension.

In accordance with yet a further feature of the invention, the devices for fastening the transmitter housing body to the nozzle of the lye runoff bellows of the tub include a fastening clip fixedly connected to the transmitter housing body and arranged in the vicinity of one of the basal end faces by three webs disposed at an angle of 90° to one another.

In accordance with yet an added feature of the invention, in an assembled position of the transmitter housing, the nozzle abuts the flexible webs of the fastening clip, the fastening clip including a strip having toothing at one of the ends thereof and, at an end thereof opposite to the one end thereof, being formed with an orifice for permitting passage to and interlocking of the toothed end.

In accordance with a concomitant feature of the invention, the devices for fastening the transmitter housing body to the body of the tub include a clamp with a radially directed extension having a first pair of wings bent resiliently on both sides towards a free end of the clamp and having a substantially rectangular profile and, springable from a concave middle part of the extension, there is a peg having a pair of diametral thickened portions, the peg carrying, at an outwardly rounded end thereof, a second pair of wings spread out from one another and directed in a sweptback manner towards the first pair of wings, the second pair of wings being formed at outer free ends thereof with a respective step for engaging in an orifice formed in the projection of the tub for anchoring the transmitter housing body to the tub.

The clip for connecting the transmitter housing to the nozzle of the lye runoff bellows of the tub and the clamp for fastening the transmitter housing to the tub can be integrally connected as fastening and connecting devices to the structure of the transmitter housing.

Thus, due to the structure of the transmitter housing itself, the latter is produced by injection molding, so that it is processed more easily and can terminate in a small thickening of both basal end faces, thus giving it greater rigidity, external connection fastenings becoming possible, without any likelihood of the body of the transmitter housing itself experiencing even the slightest deformation in the essential portions thereof, so that a completely reliable leak-tight structure is provided.

A transmitter housing with its own self-fastening and its own connection elements is described hereinbelow, the transmitter housing having a generally cylindrical hollow shape and being capable of being connected by one of the basal end faces thereof to the corresponding nozzle of the rubber lye runoff bellows or concertina of the washing machine tub, and by the other basal end face thereof to the water level transmitter. Because the transmitter housing body is produced by an injection molding process, the forming of the devices for connection to the nozzles of the lye runoff bellows and for fastening to the tub can be performed in the simplest possible manner.

The transmitter housing body has a generally cylindrical hollow shape tapered at one of the basal end faces thereof, the one basal end face being formed with an outlet having a considerably smaller diameter than at the other end, so that, because the transmitter housing body has no undercuts, it can be produced by an injection molding process which ensures that it is processed complete and ensures that both basal end faces terminate in a respective small wall thickening.

The devices for fastening the transmitter housing body to the associated nozzle of the lye runoff bellows are distinguished by a clip which is fixedly connected to the body itself and, in a practical version of the latter, is connected by a radial flexible web fixedly joined to the fastening clip, and the clip has, at one end, a toothed end portion and, at the other end, a head with a slotted orifice, through which the toothed end portion of the clip passes for the purpose of fastening the latter.

In this regard, once the end of the transmitter housing body is slipped onto the nozzle of the lye runoff bellows, the clip is bent on the web through 90° relative to the outer face of the nozzle, so that the clip comes to rest above the nozzle, and the toothed end is then led through the orifice of the head and tightened firmly.

On the other hand, the devices for fastening the transmitter housing body to the tub are distinguished by a clamp which is likewise fixedly connected to the transmitter housing body itself and which has a radial extension provided with a pair of wings directed resiliently towards the free end of the extension and having an essentially rectangular profile. Springing from the middle part of the extension is a pair of spread-open arms which terminate in the form of a barb tip, thus making it possible to fasten the transmitter housing body by leading the free ends of these arms through an orifice of the fastening body of the drum or tub.

In a practical version of the invention, the devices for fastening the transmitter housing body to the nozzle of the lye runoff bellows of the tub include a fastening clip which is fixedly connected to the body of the transmitter housing and which is arranged in the vicinity of one of the basal end faces by three webs distributed at an angle of 90° to one another.

This fastening clip is distinguished by a strip which is fixedly connected to the three radial webs on the transmitter housing body and has toothing at one of the ends thereof, while the other end thereof has a head provided with a slotted orifice and at least one inner tooth, the toothed end being introducible into the orifice and interlocked for fastening, the strip engaging around the nozzle of the rubber bellows.

On the other hand, the devices for fastening the body of the transmitter housing to the projection of the tub are distinguished by a clamp with a radially directed extension having a first pair of wings bent resiliently on both sides towards the free end of the clamp and having a substantially rectangular profile, and springing out of the concave middle part of the extension, there is a peg provided with a pair of diametral thickenings and carrying, at the outwardly rounded end thereof a second pair of wings spreading out from one another and directed in a sweptback manner towards the first pair of wings and being formed at the outer free end thereof with a depression or step for engaging in the orifice of the projection for anchoring the transmitter housing to the tub.

Other features which are considered as characteristic for the invention are set forth in the appended claims.

Although the invention is illustrated and described herein as embodied in a transmitter housing for a water level transmitter in a washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 4 is an overall longitudinal sectional view of the transmitter housing body according to the invention, shown mounted on a union or nozzle of a rubber lye runoff bellows, the transmitter housing body being fastened by the clip fixedly connected to the transmitter housing body, and being connected to the water level transmitter;

FIG. 4A is a cross-sectional view of FIG. 4 taken along the line IVA—IVA in the direction of the arrows, and providing details of the arrangement of the clip on the nozzle or union of the lye runoff bellows;

FIG. 4B is a fragmentary view of FIG. 4 rotated 90° counterclockwise and showing a fragment of the tub in cross section and how the clamp anchors the housing to the tub;

FIG. 5 is a side elevational view of another exemplary embodiment of the transmitter housing body, showing the clip for fastening the housing body to the nozzle or union surrounds the transmitter housing over an angle of 180°, the clip being connected by three webs respectively distributed at an angle of 90° to one another;

FIG. 6 is a left-hand end view of FIG. 5 showing the basal end face of the transmitter housing body illustrated in FIG. 5 for connecting the housing body to the water level transmitter, together with the fastening clip and the toothed portion and end head thereof;

FIG. 6A is an end view of the end head of the fastening clip as viewed in the of the arrow C in FIG. 6;

FIG. 6B is a cross-sectional view of FIG. 6 taken along the line VIB—VIB in the direction of the arrows;

FIG. 7 is a fragmentary side elevational view of the transmitter housing body and the device for fastening the latter to the body of the tub by an anchoring end of the device formed of a first pair of wings forming an outer curved portion to facilitate passage thereof through an anchoring orifice, and a second pair of wings directed resiliently toward the free end of the device; and FIG. 8 is an enlarged fragmentary view of the tub body showing in detail how the clamp is anchored to the tub body, the second pair of wings abutting an anchoring projection of the tub at one of the sides thereof, while the first pair of wings bears against the other side of the anchoring projection of the tub.

DESCRIPTION OF THE PREFERRED EMBODIMENTS

Figure 1:
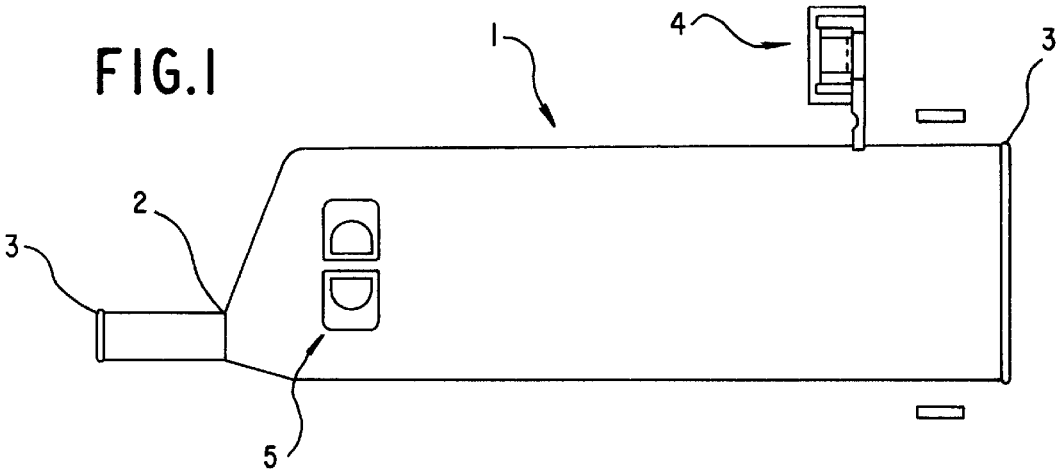
FIG. 1 is a side elevational view of an exemplary embodiment of a transmitter housing body showing two thickened basal faces thereof as well as a clip connected to the housing body by a flexible web, for fastening the housing body to a nozzle or union of a lye runoff bellows, and a clamp for connecting the housing body to the body of a tub.
Figure 2:
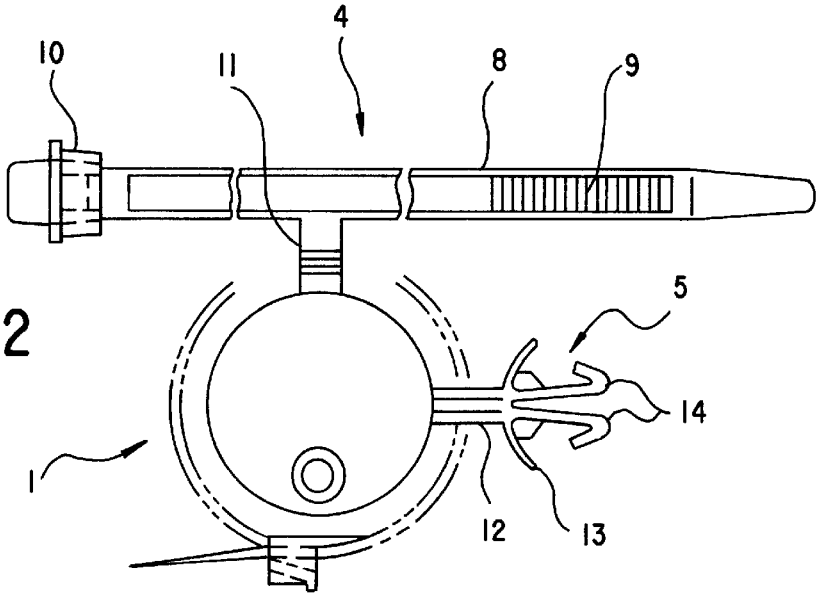
FIG. 2 is a front elevational view of FIG. 1 facing towards the basal end face of the transmitter housing body illustrated in the latter figure, namely the basal end face which is connectable to a water level transmitter, and towards the fastening clip connected to the housing body by the flexible web, the clip being shown with a toothed portion at one end thereof and a slotted head attached to the opposite end thereof.
Figure 3:
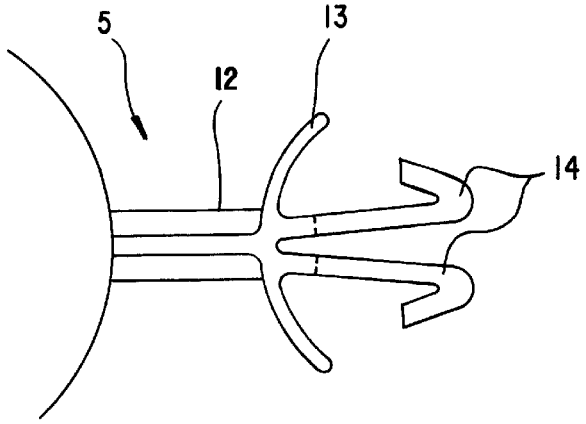
FIG. 3 is an enlarged fragmentary view of FIG. 2 showing in detail a clamp for fastening the transmitter housing body to the tub, the clamp having a radial connecting member provided with a pair of wings from which there spring two diverging arms which terminate in the form of a barb tip.

Referring now to the drawings and, first, particularly, to FIGS. 1 and 5 which illustrate exemplary embodiments of the invention wherein a body of the transmitter housing 1 has an essentially cylindrical hollow shape and, at one of the basal end faces thereof, is formed with a taper 2 for connecting the transmitter housing body to a water level transmitter.

The transmitter housing body 1 thus shaped according to FIGS. 1 to 4 is produced by an injection molding process, because it has no undercuts which could not be kept free by cores capable of being drawn out laterally. It therefore is also formed, at both basal end faces thereof, with narrow thickenings 3 which give it greater resistance to compression and prevent the rubber nozzles hoses connected thereto from slipping off.

The body 1 of the transmitter housing is also processed completely and, during the production thereof, a clip 4 and a clamp 5 are molded so as to be fixedly connected thereto, so that the body 1 is connected by the clip 4 to a nozzle or union 6 of a lye runoff bellows or concertina 7 of the tub and is fastened by the clamp 5 to the body of the tub itself.

The clip 4 is distinguished by a strip 8 which is provided with a toothed portion 9 and with a head 10 at one of the ends thereof, the head 10 being provided with a slotted orifice through which the toothed end of the strip 8 passes, in order to form a locked fastening when the head 10 is connected to the toothed portion 9. The strip 8 is fixedly connected to the body 1 by a web 11 which is directed radially away from the body 1 and which, by virtue of notching in the manner of a film hinge, permits pivoting thereof through an angle of 90°, so that the strip 8 is pivoted onto the end of the nozzle or union 6 of the runoff bellows 7, as shown in FIG. 4.

The web 11 for connecting the clip 4 is provided with a weakened portion, i.e., notching in the manner of a film hinge, which makes it easier for the web to bend, so that, during the pivoting through 90°, the strip 8 ultimately engages around the nozzle or union 6 of the lye runoff bellows 7 of the tub or drum and permits fastening of the strip completely.

Finally, the clip 4 is located in the vicinity of the larger-diameter basal end face of the transmitter housing body, and the mounted nozzle or union 6 of the runoff bellows 7 abuts the radial web 11.

On the other hand, the clamp 5 is fixedly connected to the body 1 of the transmitter housing by a radial extension 12 which is provided with a pair of wings 13 directed resiliently towards the free end of the extension and having a substantially rectangular profile. Springing out of the middle part of the extension is a pair of spread-open arms 14 which terminate in the form of a barb tip, so that, during the fastening of the transmitter housing body 1 to the body of the tub, ends of the arms 14 of this clamp pass through an orifice 15 of the anchoring projection 16 of the tub, and the arms 14 spread behind the projection.

Thus, during the production of the body 1 of the transmitter housing of the aforedescribed type, the need for a metal clip for fastening the nozzle or union of the runoff bellows and a plastic clip with its conventional pressure screw onto the body of the tub is avoided, so that the transmitter housing body is ultimately more economical and, due to the possibility of its production by injection molding, offers improved tightness or leakproofing.

Furthermore, the assembly of the aforedescribed transmitter housing body is much quicker and simpler than conventional housing bodies, because it is sufficient to slip the end having the larger diameter onto the nozzle 6 of the runoff bellows 7 and fix the connection with the clip 4 which is simply pivoted through 90° in relation to the web 11 and closed by interlocking when the strip 8 passes through the head 10. The body 1 can then be fastened to the tub by the clamp 5, the free end of the spread-out arms 14 being inserted through the associated orifice 15 of the anchoring projection 16 so that, finally, the free end abuts the resilient wings 13 on the outside and the barb-shaped arm ends 14 on the inside, as shown in detail in FIG. 4.

In another practical embodiment of the invention according to FIGS. 5 to 8, although the clip 4 for connecting the housing body 1 to the nozzle 6 of the lye runoff bellows 7 of the tub, and the clamp 5 for fastening the housing body 1 to the body of the tub are likewise fixedly connected to the transmitter housing body 1, the clip 4 is nevertheless distinguished, in this embodiment, by a strip 17 which is fixedly connected to the transmitter housing body 1 by three webs 18 arranged at an angle of 90° to one another, this strip 17 again having a toothed portion 19 at one of the ends thereof and, at the other end thereof, a head 20 which is provided with an orifice 21 for the passage and anchoring of the toothed end 19 when the strip is fastened to the nozzle 6 of the lye runoff bellows 7 of the tub.

During the assembly of the transmitter housing body 1, the latter is slipped in this manner onto the nozzle 6 of the lye runoff bellows 7, until the nozzle 6 abuts the webs 18, and thereafter is affixed with the clip 4 by anchoring the toothed end 19 in the head 20 of the fastening clip 17.

Furthermore, the clamp 5 is also distinguished by a body which is fixedly connected radially to the transmitter housing body. For this purpose, the clamp 5 has a radially directed extension which has a first pair of wings 22 bent resiliently on both sides toward the free end of the clamp and having a substantially rectangular profile. Springing out of the concave outwardly directed middle part of the extension is a peg formed with a pair of thickenings or thickened portions 23 having a width similar to that of the orifice 15 of the anchoring projection 16 of the tub body. The outwardly rounded free end 26 of the clamp terminates in a pair of diverging wings 24 directed towards the pair of bent wings 22 and being formed with a small step 25 at the respective outer ends of the diverging wings 24.

The clamp 5 can thus be inserted in a relatively simple manner into the orifice 15 of the anchoring projection 16 of the tub, and is fastened when it locks into the steps 25 of the outer surface of the wigs 24 while, during insertion into the orifice 15, the thickened portions 23 contribute to the anchoring and fixing of the clamp 5 when the bent wings 22 abut the opposite side of the anchoring projection 16.

Finally, the features specified hereinbefore provide for a transmitter housing body which can be produced and assembled more economically and which has improved leaktight properties and a considerable economic saving in terms of mass production because it is assembled very simply and quickly in comparison with the conventional form of such a housing body.

I claim:

1. A transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, comprising one of a jet molded and an injection molded substantially hollow-cylindrically shaped transmitter housing body and including devices for fastening said transmitter housing body to the nozzle of the lye runoff bellows and devices for connecting said transmitter housing body to a body of the tub, said devices for fastening, said devices for connecting, and said transmitter housing body being formed as one piece.

2. The transmitter housing according to claim 1, wherein the basal end faces are formed on said transmitter housing body and have reinforcing thickenings.

3. The transmitter housing according to claim 1, wherein said devices for fastening said transmitter housing body to the nozzle of the lye runoff bellows include a fastening clip fixedly connected to said transmitter housing body and being disposed in the vicinity of one of the basal end faces through the intermediary of a flexible strap or web.

4. The transmitter housing according to claim 3, wherein said fastening clip includes a partially toothed strip which, when passed through a slot-like orifice in a toothed end head of the fastening clip, is in cooperative engagement with at least one tooth of the end head.

5. The transmitter housing according to claim 4, wherein, in an assembled position of the transmitter housing, the nozzle abuts said flexible web of said fastening clip which, for fastening the transmitter housing to the nozzle, is pivotable through an angle of 90° towards the nozzle and is closable in said end head by said toothed strip.

6. The transmitter housing according to claim 1, wherein said devices for connecting said transmitter housing body to the body of the tub include a clamp engageable with the tub body through an orifice formed in a projection of the tub body.

7. The transmitter housing according to claim 6, wherein said clamp for fastening said transmitter housing body to the tub has a radial extension formed with a pair of wings directed resiliently towards a free end of said radial extension and having a substantially rectangular profile, and a pair of spread-open arms terminating in the form of a barb tip springable from a middle part of said extension.

8. The transmitter housing according to claim 1, wherein said devices for fastening the transmitter housing body to the nozzle of the lye runoff bellows of the tub include a fastening clip fixedly connected to the transmitter housing body and arranged in the vicinity of one of the basal end faces by three webs disposed at an angle of 90° to one another.

9. The transmitter housing according to claim 8, wherein, in an assembled position of the transmitter housing, the nozzle abuts said flexible webs of said fastening clip, said fastening clip including a strip having toothing at one of the ends thereof and, at an end thereof opposite to said one end thereof, being formed with an orifice for permitting passage to and interlocking of said toothed end.

10. The transmitter housing according to claim 1, wherein said devices for connecting the transmitter housing body to the body of the tub include a clamp with a radially directed extension having a first pair of wings bent resiliently on both sides towards a free end of the clamp and having a substantially rectangular profile and, springable from a concave middle part of said extension, there is a peg having a pair of diametral thickened portions, said peg carrying, at an outwardly rounded end thereof, a second pair of wings spread out from one another and directed in a sweptback manner towards said first pair of wings, said second pair of wings being formed at outer free ends thereof with a respective step for engaging in an orifice formed in a projection of the tub for anchoring the transmitter housing body to the tub.

11. A transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, comprising a transmitter housing body having one of a jet molded and an injection molded generally hollow-cylindrical shape and including devices for connecting said transmitter housing body to a body of the tub and devices for fastening said transmitter housing body to the nozzle of the lye runoff bellows having a fastening clip fixedly connected to said transmitter housing body and being disposed in the vicinity of one of the basal end faces through the intermediary of a flexible strap or web.

12. The transmitter housing according to claim 11, wherein the basal end faces are formed on said transmitter housing body and have reinforcing thickenings.

13. The transmitter housing according to claim 11, wherein said fastening clip includes a partially toothed strip which, when passed through a slot-like orifice in a toothed end head of the fastening clip, is in cooperative engagement with at least one tooth of the end head.

14. The transmitter housing according to claim 13, wherein, in an assembled position of the transmitter housing, the nozzle abuts said flexible web of said fastening clip which, for fastening the transmitter housing to the nozzle, is pivotable through an angle of 90° towards the nozzle and is closable in said end head by said toothed strip.

15. A transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, comprising a transmitter housing body having one of a jet molded and an injection molded generally hollow-cylindrical shape and including devices for fastening said transmitter housing body to the nozzle of the lye runoff bellows and devices for connecting said transmitter housing body to a body of the tub having a clamp engageable with the tub body through an orifice formed in a projection of the tub body.

16. The transmitter housing according to claim 15, wherein said clamp for fastening said transmitter housing body to the tub has a radial extension formed with a pair of wings directed resiliently towards a free end of said radial extension and having a substantially rectangular profile, and a pair of spread-open arms terminating in the form of a barb tip springable from a middle part of said extension.

17. A transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, comprising a transmitter housing body having one of a jet molded and an injection molded generally hollow-cylindrical shape and including devices for connecting said transmitter housing body to a body of the tub and devices for fastening said transmitter housing body to the nozzle of the lye runoff bellows having a fastening clip fixedly connected to the transmitter housing body and arranged in the vicinity of one of the basal end faces by three webs disposed at an angle of 90° to one another.

18. The transmitter housing according to claim 17, wherein, in an assembled position of the transmitter housing, the nozzle abuts said flexible webs of said fastening clip, said fastening clip including a strip having toothing at one of the ends thereof and, at an end thereof opposite to said one end thereof, being formed with an orifice for permitting passage to and interlocking of said toothed end.

19. A transmitter housing for connecting a water level transmitter to a lye runoff bellows in a washing machine, the transmitter housing having an elongated and cylindrical shape and being connected at a basal end face thereof to a corresponding nozzle of a lye runoff bellows of a tub of the washing machine and being connected by the other basal end face thereof to the water level transmitter, comprising a transmitter housing body having one of a jet molded and an injection molded generally hollow-cylindrical shape and including devices for fastening said transmitter housing body to the nozzle of the lye runoff bellows and devices for connecting said transmitter housing body to a body of the tub having a clamp with a radially directed extension having a first pair of wings bent resiliently on both sides towards a free end of the clamp and having a substantially rectangular profile and, springable from a concave middle part of said extension, a peg having a pair of diametral thickened portions, said peg carrying, at an outwardly rounded end thereof, a second pair of wings spread out from one another and directed in a sweptback manner towards said first pair of wings, said second pair of wings being formed at outer free ends thereof with a respective step for engaging in an orifice formed in a projection of the tub for anchoring the transmitter housing body to the tub.

* * * * *